US009797126B2

(12) United States Patent
Saggese

(10) Patent No.: US 9,797,126 B2
(45) Date of Patent: Oct. 24, 2017

(54) MULTIFUNCTIONAL ENCLOSURE

(71) Applicant: Sebastian Saggese, Buenos Aires (AR)

(72) Inventor: Sebastian Saggese, Buenos Aires (AR)

( * ) Notice: Subject to any disclaimer, the term of this patent is extended or adjusted under 35 U.S.C. 154(b) by 0 days.

(21) Appl. No.: 14/491,947

(22) Filed: Sep. 19, 2014

(65) Prior Publication Data

US 2017/0247876 A1 Aug. 31, 2017

(51) Int. Cl.
*E04B 1/343* (2006.01)
*E04D 13/035* (2006.01)

(52) U.S. Cl.
CPC ..... *E04B 1/34305* (2013.01); *E04B 1/34363* (2013.01); *E04D 13/035* (2013.01)

(58) Field of Classification Search
CPC E04B 1/34305; E04B 1/34363; E04D 13/035
USPC ..... 52/71
See application file for complete search history.

(56) References Cited

U.S. PATENT DOCUMENTS 3,845,591 A * 11/1974 Stine ..... E04B 1/34305 135/129
5,203,125 A * 4/1993 Sugizaki ..... E04B 1/34305 52/66
5,233,799 A * 8/1993 Abukawa ..... B21D 5/08 52/53
5,687,816 A * 11/1997 Wusthof ..... B66F 7/16 187/205
6,430,879 B1 * 8/2002 Nuiry ..... E04B 1/34305 4/498
6,604,327 B1 * 8/2003 Reville ..... E04H 3/165 49/258
2003/0014927 A1 * 1/2003 Brooks ..... E04B 1/0046 52/66
2011/0308173 A1 * 12/2011 Forsland ..... E04B 1/0046 52/67
2015/0121778 A1 * 5/2015 Rawding ..... E04H 9/145 52/169.9
2016/0281349 A1 * 9/2016 Kasanen ..... E04H 6/44

FOREIGN PATENT DOCUMENTS

EP 0253411 A3 * 9/1988 ..... E04H 6/02
ES 2063610 A2 * 1/1995
ZA WO02072969 A1 * 9/2002

* cited by examiner

*Primary Examiner* — Paola Agudelo

(57) ABSTRACT

A manual or motor activated enclosure, appropriate for any surface to be enclosed, comprising matching opposite cross-linked structures containing a set of profiles that fits in the field of telescopic modular pivoting roof structures, that upon retraction it is housed underground such that none of its components are visible above ground, and upon deployment it achieves complete enclosure of the area while proving for openings.

10 Claims, 23 Drawing Sheets

MULTIFUNCTIONAL ENCLOSURE

CROSS REFERENCE TO RELATED APPLICATIONS

This application claims priority from Argentina's Instituto Nacional de la Propiedad Industrial, patent application #20130103381, titled "CERRAMIENTO MULTIFUNCIONAL" (Multifunctional Enclosure, in English), filed on Sep. 20, 2013, based on the Paris Convention for the Protection of Industrial Property, subscribed by the Argentine Republic and the United States of America, the entire contents of which are herein incorporated by reference.

FEDERALLY SPONSORED RESEARCH

Not Applicable

SEQUENCE LISTING OR PROGRAM

Not Applicable

REFERENCES CITED

EP0253411A2
ES2063610A2
U.S. Pat. No. 3,845,591
U.S. Pat. No. 6,604,327
WO02072969A1

BACKGROUND OF INVENTION

Field of the Invention

The present invention refers to a "MULTIFUNCTIONAL ENCLOSURE", appropriate for any surface to be enclosed, both external and internal, in which it comprises a cross-linked structure containing a set of profiles that fits in the field of telescopic retractable roof structures, in particular structures composed primarily of profiles used in the field of architecture and construction.

Background

Traditionally enclosure systems may be classified as those suitable for closed areas and outdoor areas. The first group comprises those enclosures that permit use and enjoyment every day of the year, regardless of weather conditions. The second group refers to all those enclosures that open wholly or partly to the open air. To this second group, the present invention is intended.

To make better use of the outdoor places, various enclosure systems were developed, generally consisting of roofs with partial openings that can be opened or closed in the manner of windows, fully or partially, that may be opened when weather conditions are favorable.

To this end, various systems have been developed and used, including:

- Protective canvas or awnings;
- Tents, made of various materials such as canvas or plastic, with rigid or inflatable support structures (the whole tent is inflated, which requires monitoring its air leakage with the consequent continuous energy expenditure, or only the supporting structure is inflatable);
- Removable modules removable at will, which must be completely dismantled when not in use.
- Retractable module roofs that result in visible retracted structures at the ends of the area to be covered or have the need for providing a large enclosed space to hide them.

- Sliding covers that allow for a limited opening, always leaving a covered portion, since the entire structure (walls and/or roof) moves in modules, which are inserted one inside the other, to occupy one end portion thereof; being that in some cases the walls are fixed and only the corresponding portion of the roof moves leaving always a covered airspace.

All these solutions generally do not resolve the problem of dealing with the weight of the modules. Most sliding modules are difficult to move to a desired position because they employ mechanical means, pulleys and chains, which are used to manually move the modules. If the modules need to be moved by pushing there is a risk that they may lock.

As for pavilion type enclosures, there are a variety of models, fixed or telescopic, made of various materials, such as canvas or metal. Telescopic enclosures may be retracted and still occupy a fifth or a sixth of its original size.

In regards to the perimeter structures that support a sliding roof, they generally have multiple drawbacks. These structures have to bear the weight coupled with sliding modules' movements, thus they present a variety of construction issues such as tension, vibration, and possible deformation from buckling, all issues that require expensive systems because of materials used, resulting in increased weight and cost of the entire structure.

Enclosure systems that use rail tracks to displace themselves always have some possibility of locking on the tracks.

It must be noted that hereinafter when referring to a structure, module, or enclosure that it is closed, it implies that the modules are in position to total coverage of the surface, and when it is said to be open it implies that the modules are fully stored in underground chambers releasing all the space above ground.

The proposed invention solves all aforementioned problems, because there are no bearings circulating over rails and especially because once the structure is fully retracted it is hidden from view, freeing the space previously covered.

The process of opening and closing the enclosure may be effected mechanically. The use of counterweights for pivoting the structures makes manual operation of the enclosure possible. The simplicity of operation eliminates the need for trained personnel for their handling. It also allows for usage of the enclosure as often as desired.

Another possibility is the opening and closing of the enclosure by using a motor and a programmable computer that allows for scheduling and pre-defined frequencies of operation.

All the above mentioned problems can be solved by the present invention, whose opening and closing is accomplished telescopically, and may be used to cover areas such as: swimming pools, sports fields, greenhouses, gardens, patios, work areas, isolation areas, parking lots, and similar.

The following prior art is known to the inventor.

Spanish Patent ES2,063,610, discloses a fixed circular lattice structure, over which layered structures shaped as wedges are affixed to its perimeter, and pivot on it and lean to one side or the other causing the partial opening of the enclosure or its total closure. The problems presented by this invention are:

- The segments tend to jam if they are not perfectly synchronized in their movement;
- Space around the enclosed area does become completely free; a portion of the structure is visible on the ground;
- The deformation of the segments due to temperature variations and use increases the chances of jamming;
- Its does not allow for placement of an enclosure in a small area.

U.S. Pat. No. 3,845,591 discloses a telescopic enclosure that extends horizontally. It consists of segments of different sizes such that upon retraction each segment is contained underneath the previous segment. The structure moves over side rails. The problems presented are:

The segments tend to jam while circulating over rails;

Rails must be periodically maintained to prevent the bearings from locking;

Not all space is liberated upon opening the enclosure, part of the structure remains visible and above ground;

The structure is usable to enclose small areas since its configuration limits its elements to exceed certain size because of weight and maneuverability.

WIPO application WO0/2072969 discloses a telescopic rectangular enclosure that can be extended horizontally. It consists of segments of different sizes that may be retracted and stored below the previous segment. The segments move by rolling over side rails on the floor. The ends of the enclosure may be closed by means of a retractable semicircular dome formed by U-shaped modules united together at their pivoting points. The problems presented by this invention are:

The modules in movement tend to lock while circulating on the rails;

Space above ground is not free, part of the structure remains visible;

The structure is usable to enclose small areas.

U.S. Pat. No. 6,604,327 B1 discloses a telescopic enclosure that can extend horizontally. It consists of segments of different sizes that may be retracted and stored below the previous segment. The segments move by rolling over wheels over the floor. The problems presented by this invention are:

The modules in movement tend to lock easily since there is no guide to keep all wheels aligned;

Space above ground is not free, part of the structure remains visible;

Applicable only to small areas.

European Patent EP 0253411 discloses several enclosure options. Focusing on a relevant option, a telescopic rectangular enclosure may be extended horizontally and consist of segments of different sizes that may be retracted and stored below the previous segment. The structure circulates over wheels and its ends are retractable, closable by semicircular dome modules formed by inverted U shape wedges. The problems presented by this invention are:

The modules tend to lock while circulating on the rails;

Space above ground is not free; part of the structure remains visible;

The structure is usable to enclose small areas.

SUMMARY OF THE INVENTION

The object of the present invention is a to provide for a multifunctional enclosure, for covering outdoor and indoor areas, which comprises a set of components operatively linked together, forming an enclosure that can be retracted completely and be hidden out of sight; having features that solve the previously mentioned problems.

When the enclosure is retracted, it frees completely the area above ground as the entire structure is stored below ground level and out of sight;

When the enclosure is deployed it covers the entire desired area, being suitable for large areas;

The component modules do not travel over the ground, either on rails or wheels, rather the modules pivot on their axis, thereby eliminating the inconvenience caused by wear and jamming of wheels caused by the horizontal displacement of the modules;

Module's movement is not hindered by obstacles as bearings maintain separation between modules and ensure smooth and fluid movements;

Each half of the enclosure pivots on its own axis, therefore the total load is divided;

It allows for the placing of openings, such as access doors and windows;

The enclosure modular structure makes it ideal for manufacturing, transport, and installation at different locations.

The inventive enclosure is composed of a series of modules arranged in two parallel halves facing each other. Each one of the modules has a section of parabolic profile shape and the length of the area to be covered, and it is connected to an axis upon it rotates.

The number of modules in each half of the enclosure can vary according to the dimensions of the area to be covered. All modules in each half share the same horizontal axis; both axes are located below ground level, in parallel to each other.

The size of the modules varies from one another due to construction requirements, such as the location of an access door or opening, which requires certain modules to have an angle greater than others, whereby the wedge of the modules of each half does not always have the same angle as the opposite module. This means that each half module has different length and diameter that range from larger on the outside to smaller on the inside, also one side may have more modules than the other side.

The radius and length difference between modules is such that allows for a proper fit between them to open and close, while determining the clearance or gap light needed to allow for deformations provided in each case and the smooth functioning without trouble.

The rotational movement of the modules around their axes allows for a proper fit between each other in the perimetral underground housing, reducing the space required and at the same time offering the possibility for the total deployment of the structure to the deployed position.

Each module consists of two wedge-shaped panels, one in front and one on the rear, connected by its wider end (the side opposite the axis) through multiple beams, two of which connect the inside corners facing each other (hereinafter upper and lower beams) and the rest connecting the middle part (hereinafter middle beam) giving it structural stiffness and support to the laminar material that will be used to close the resulting intermediate spaces. On the inner facing sides of the beams, multiple perpendicular ribs are affixed thereto and spaced at equal distances, and upon which the laminar material mentioned above is interspersed, these ribs converging on at least one axis associated with a motor.

Each panel shaped wedge will consist of two radial profiles or studs attached at one end (the apex of the wedge), with another profile that will unite them at the other end giving the characteristic wedge shape to the whole module and can present in its middle part a section of arch or curved profile affixed to the internal face of the studs. The radial profile or attack stud of each module, which is the one closer to the middle of the deck to be deployed, or that remains at ground level when retracted, may present an extension to the opposite side of the axis to facilitate the rotation of the panel about its axis on the following ways:

By placing counterweights on the extension. These counterweights are located interspersed and sized not to interfere with their movement or with other modules in the opposite side; or by applying the necessary force to the end thereof to the lever advantage (such as by steel cables, gears, mechanical, elastic, or hydraulic devices).

By using a counterweight extension, it allows for the rotation of the modules by applying a small force on said extensions, which requires using a smaller motor and therefore less energy or the possibility to use manual force.

A bracket may be affixed to some joints between two profiles to ensure its squareness and to further strengthen the joints and the whole structure. Optionally, the brackets may be placed on internal corners or only on those unions that bear a higher load, to reduce the overall weight of the module.

Near the apex of the wedge-shaped panels is the opening where the axis is located. The external module, hereinafter drag module, may rest at 90 degrees to the ground, when in its deployed position, will be firmly fixed to said axis. The remaining modules will turn freely around said axis, linked to it through bearings to reduce the friction, so that turning the axis will turn the drag module and the module will drag the next module by a pulling action exerted by an abutment flange or stop. The flange runs through the longitudinal extension of the module and is disposed on the inner side of each lower beam (except for the lower module that does not having such a flange). The flange abuts against another like flange located on the outer side of each upper beam (except for the upper module that does not have such a flange).

The lower module that remains in contact with the ground surface may contain apertures, such as a door or a window.

The modules, which connect with each other in the deployed position, form a half cylinder that conforms the roof and sides of an enclosure, and the semicircular sections of each module complete the front and back faces of semicircular cover.

Each module is formed by cross-linking said beams and ribs with the resulting spaces in between them filled with foil material, either translucent or opaque.

Since modules are loaded on the same horizontal axis, each one can be moved from an angle that positions it below the ground line within underground housing (open or rest position when the cover is not in use) to a deployed position, in which the modules are located so that they connect to each other through their upper and/or lower edges by flanges or tabs above mentioned, completing each half an arch of 90 degrees.

As mentioned, there are three attack/contact beams in each module, which are positioned upside when the structure is opened.

The beams corresponding to the profile of the upper module are designed and positioned so as to ensure the tightness of the enclosure when, in the deployed position, makes contact with the other module. The beams corresponding to the profiles of the remaining modules are designed and positioned in such a way to ensure the tightness of the enclosure when deployed and to make contact with the studs and lower beams of the adjacent upper module through the said flange.

The design of the joints between different modules and the semicircular shaped enclosure guarantees a free water runoff adjacent to the lower module and the tightness of the joints of the profiles with laminar sealing material. In turn, the upper module has a slanting in the last part (the top) that facilitates the disposal of water, snow, ice, or other liquids.

The process of opening and closing the enclosure may be performed mechanically with the help of motors, but the use of counterweights for pivotal structures makes opening manually feasible. This simplicity of operation eliminates the need for trained personnel with special skills. It also allows the utilization as frequent as desired.

The deployment of the enclosure may be performed with the help of one or two synchronized motors, pulleys, or hydraulic pistons applied to the modules or beams.

If motors are used, the opening and closing of the structure may be automated, so it is possible to schedule and pre-defined operating frequencies.

In order to reduce structural stress caused by the operation of the enclosure, it is possible to apply forces to the end of the extensions designed to partially offset the weight of the modules, which can be static, linear, hydraulic, spring loaded, mechanical, or elastic, such as counterweights.

In a preferred embodiment shown, counterweights consist of a radial extension to the main radius of each module, with the radial development required (in the opposite direction to the module).

The dimensions of the counterweights, as shown in the embodiment, may vary depending on the soil type and the topography since it will determine the depth of the excavation.

The axes that serve for rotation of the modules (and corresponding counterweights) include bearings supported by a rigid structure affixed on a firm base on each side at the ends of each drag module.

Access to the interior of the structure, when deployed, is made through one or more openings located on the lower module of one or both principal sections.

In order to reduce any rubbing or friction, avoid obstacles, and maintain the necessary gap between the modules for the smooth running of the enclosure, bearings are disposed on the inner and outer faces.

The underground storage or housing is located on the perimeter of the area to be covered. It consists of a compartment closed on all sides except the necessary opening gap for the entry and exit of the modules and the maintenance access that may be required.

The sealing, total or partial, of the housing is achieved with the use of a perimeter rain cover and collector. In the embodiment, both elements, rain cover and rain collector, are part of the movable structure with the first connected to the upper beam of the main module and the second connected to the lower beam of the module, this greatly simplifies the operation of the structure.

In the case of covering large areas, a series of arches, fixed or telescopic, may be added to the enclosure structure to provide the necessary support while matching the curvature of the modules. For this, each module in the underside of the beams may have bearings to match and position the supporting arches used.

DETAILED DESCRIPTION OF THE INVENTION

Figure 1:
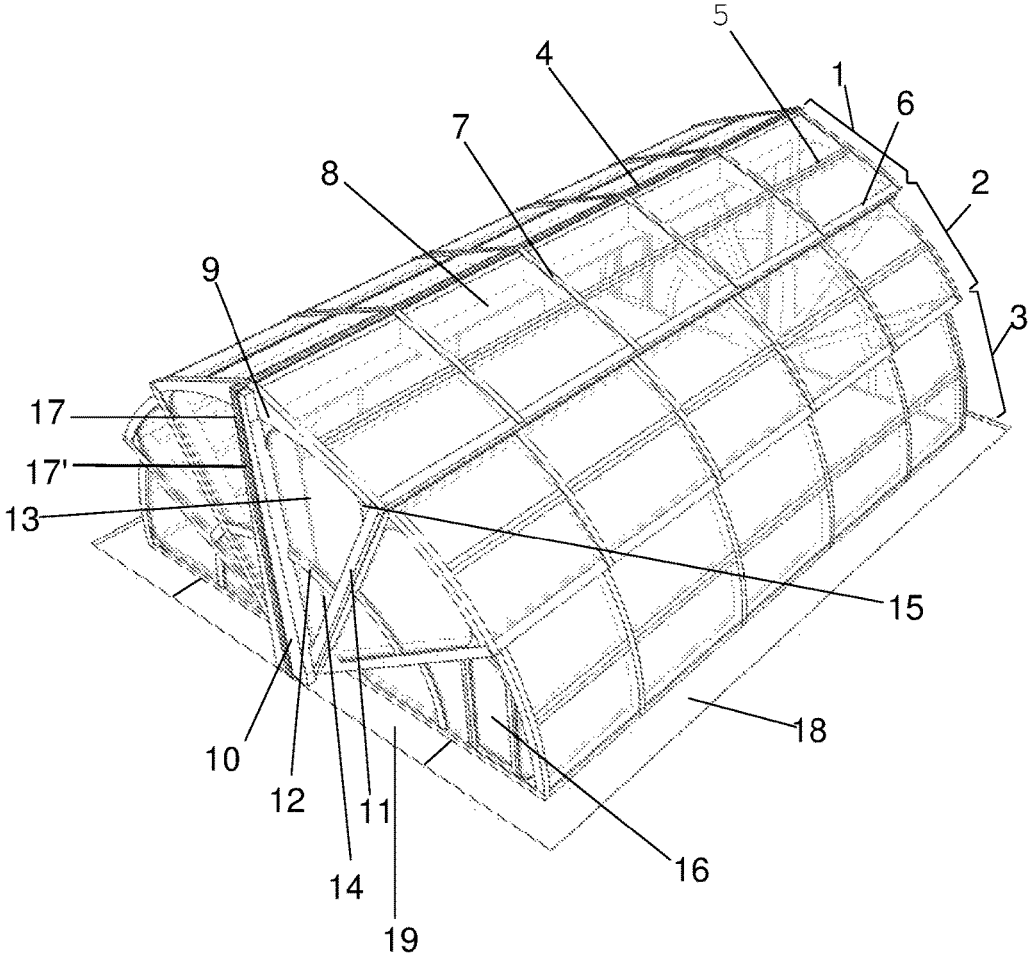
FIG. 1 is a perspective view of the enclosure in the closed position.

In order that the present invention may be clearly understood and implemented the preferred embodiment is disclosed hereinafter. An accurate description of a preferred embodiment with reference to the same to the accompanying schematic drawings, given that in all figures the same reference numerals that indicate like or corresponding elements; the preferred embodiment is one of many and it is purely illustrative and in no way limiting of the invention.

FIG. 1 is a perspective view of the inventive enclosure in the deployed position where it may be observed that each half of the enclosure is made of upper module (1), medium module (2), and lower module (3). Each of the modules consist of a plurality of longitudinal beams, herein shown an upper beam (4), a middle beam (5), and a lower beam (6), and a plurality of transversal ribs (7). The spaces delimited by the beams and ribs are filled by foil material covering (8). A wedge-type front and rear panels are formed by an upper profile beam (9) and two lateral or axial profiles beams (10, 11), a middle a curved profile rib (12) is used to strengthen the panels. Foil material covering (13, 14) fills the spaces delimited by the various beams and ribs. Brackets (15) may be used to strengthen the enclosure structure. One or more modules or panels may have an opening, such as a door (16), shown at the lower module (3). The upper module (1) on each half of the enclosure is framed by a closing or attack beam (17, 17') that together function as underground housing covers, and the rainwater collectors (18, 19) of the lower module (3).

Figure 2:
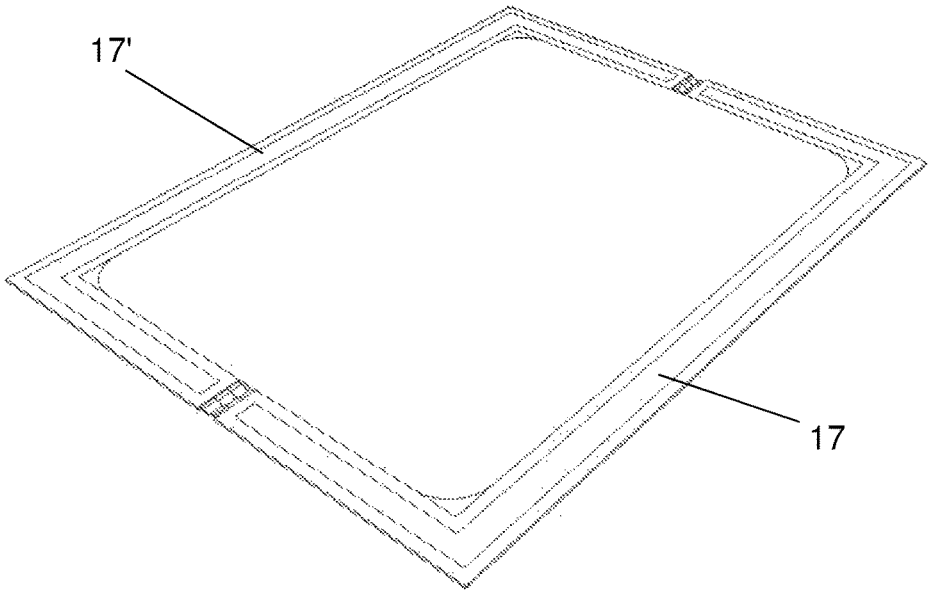
FIG. 2 is a perspective view of the enclosure in open condition.

FIG. 2 is a perspective view of the enclosure in the open position showing the underground housing covers (17 and 17').

Figure 3:
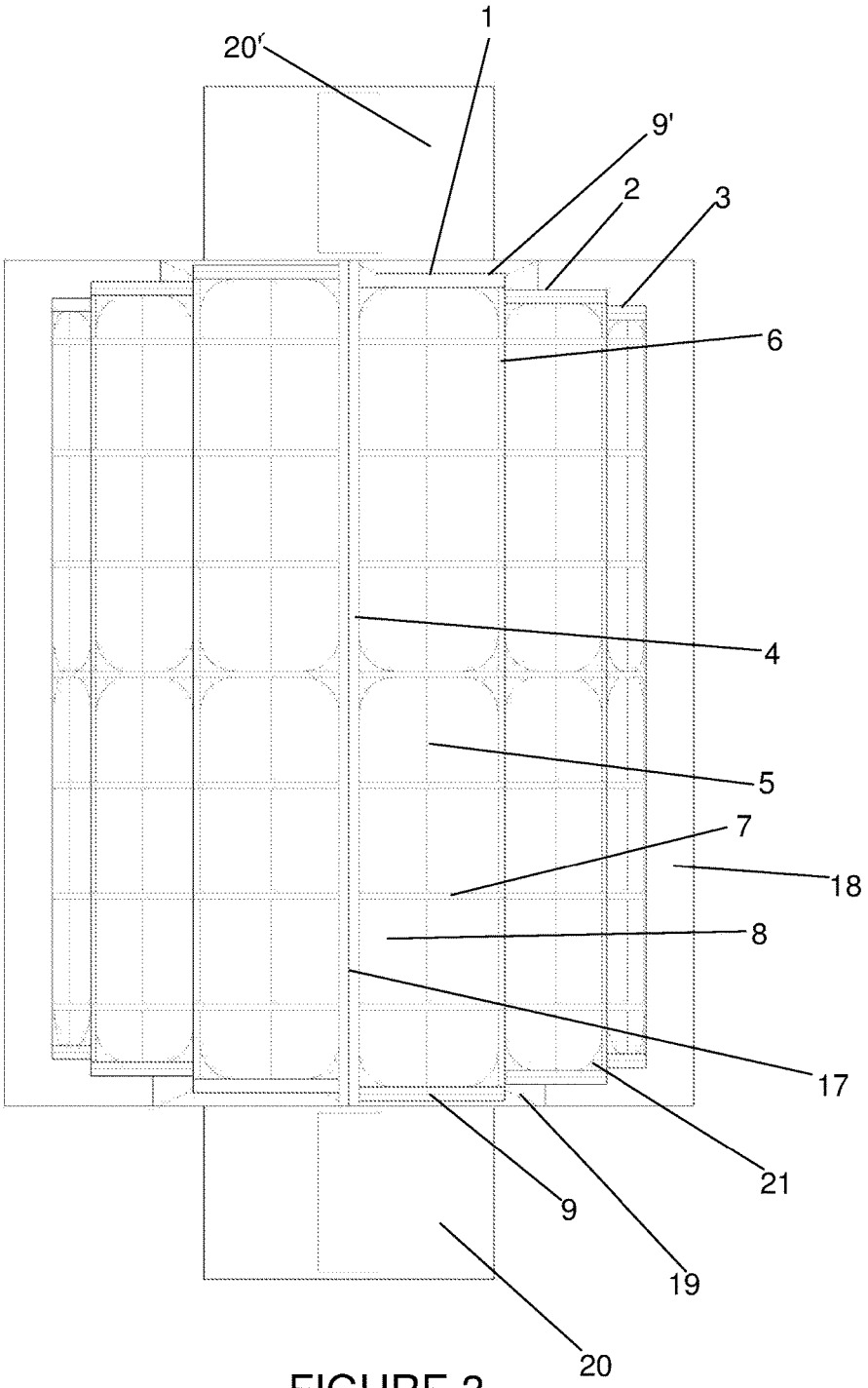
FIG. 3 is a top view of the enclosure in the closed condition.
Figure 4A:
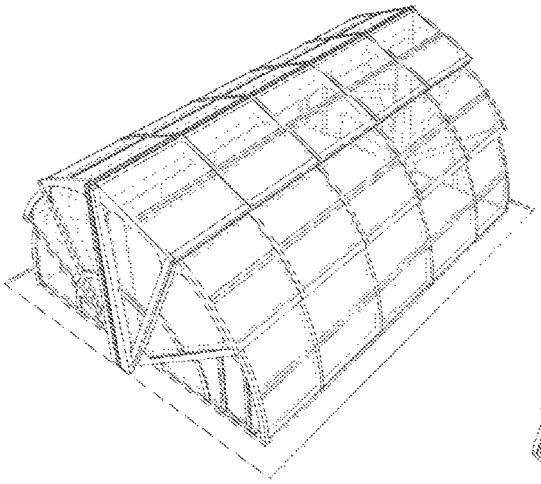
FIGS. 4A, 4B, 4C, and 4D are a sequence of perspective views of the operational condition of the enclosure.
Figure 4B:
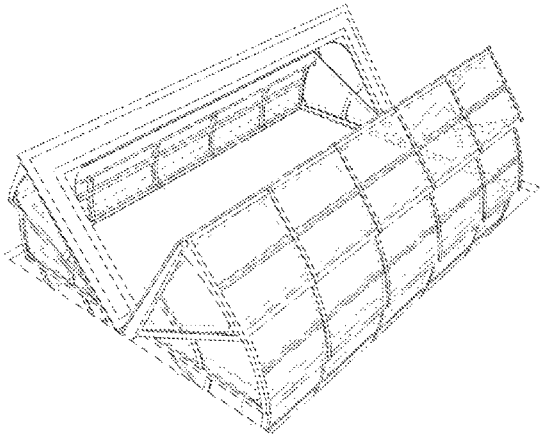
Figure 4C:
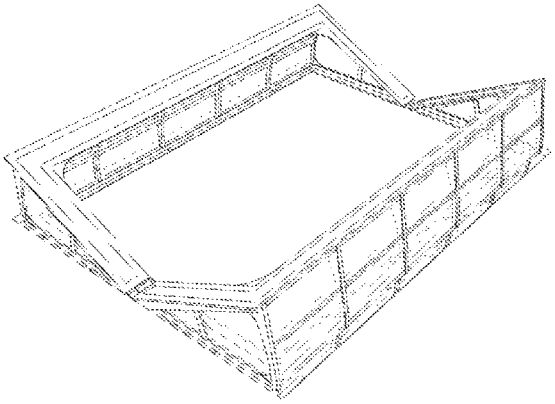
Figure 4D:
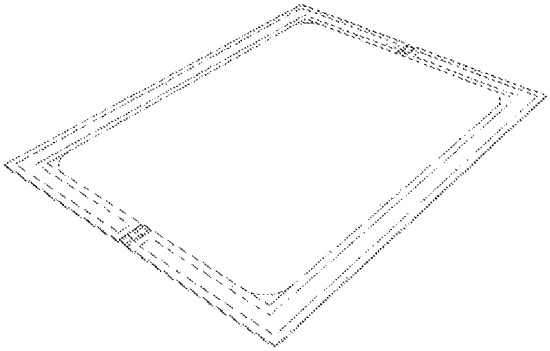

FIG. 3 is a top view of the inventive enclosure in the deployed position showing that each half of it is made by the upper module (1), middle module (2), and lower module (3). Each module consists of an upper beam (4), a middle beam (5), a bottom beam (6), a plurality of ribs or intermediate sections (7), foil material covering the spaces delimited by the beams and ribs (8), and two wedge type panels of which it can be seen the upper profile beam (9, 9'). The attack beam of the upper module (1) forms the underground cover (17). Shown also are the rainwater collector (18) of the lower module (3), the front rain collector (19), the underground engine compartments (20 and 20'), and the structural supporting brackets (21). This figure shows clearly how the modules of one half are offset with respect to the modules of the other half, so that they may be interposed half on the modules of the other half, to allow proper rotation without interfering with its extensions or counterweights. In the event that counterweight extensions are not used, it is not necessary to maintain an offset of the modules.

FIG. 4 shows a sequence of perspective views of the evolution of the enclosure. Looking from top to bottom: 4A: Enclosure completely deployed; 4B: Partial opening; 4C: Partial opening; 4D: Enclosure fully open.

Figure 5:
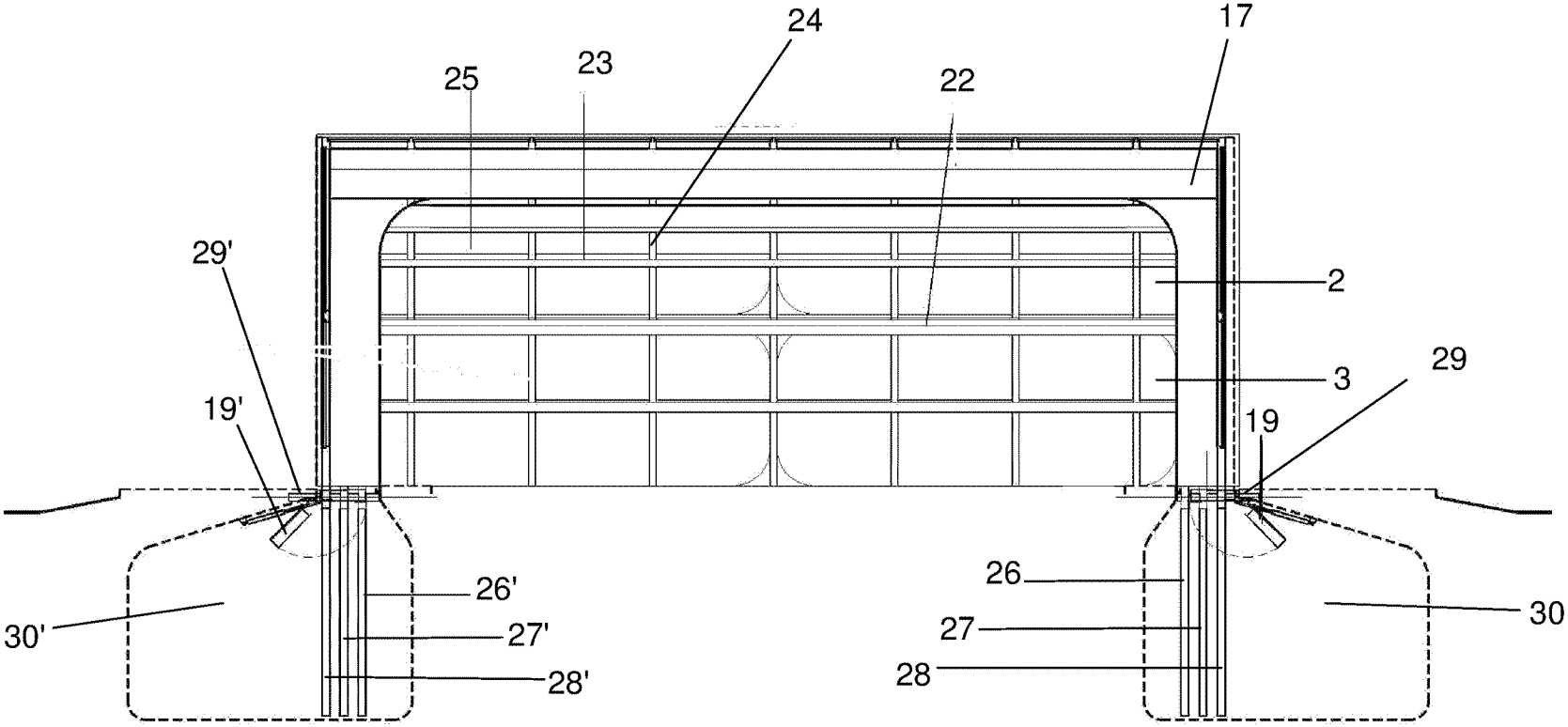
FIG. 5 is a longitudinal cross sectional view through the middle of the enclosure in a closed position, where the modules making up one half of the enclosure may be observed.

FIG. 5 shows a longitudinal sectional view of the deployed enclosure, so that the modules which make one half of the enclosure are observable. The upper module framed by underground cover (17) is appreciated, as are middle module (2), and lower module (3). The front and rear covers (19 and 19'), which are retractable, and the lower (22) and middle (23) beam from the middle module (2), as well as ribs or intermediate sections (24), and the foil material covering the space delimited by the beams and ribs (25). Counterweights (26, 27, 28 and 26', 27', 28') used in this embodiment are observed as are the front and rear axles (29 and 29') for this half of the enclosure and the front and back underground housing (30 and 30').

Figure 6:
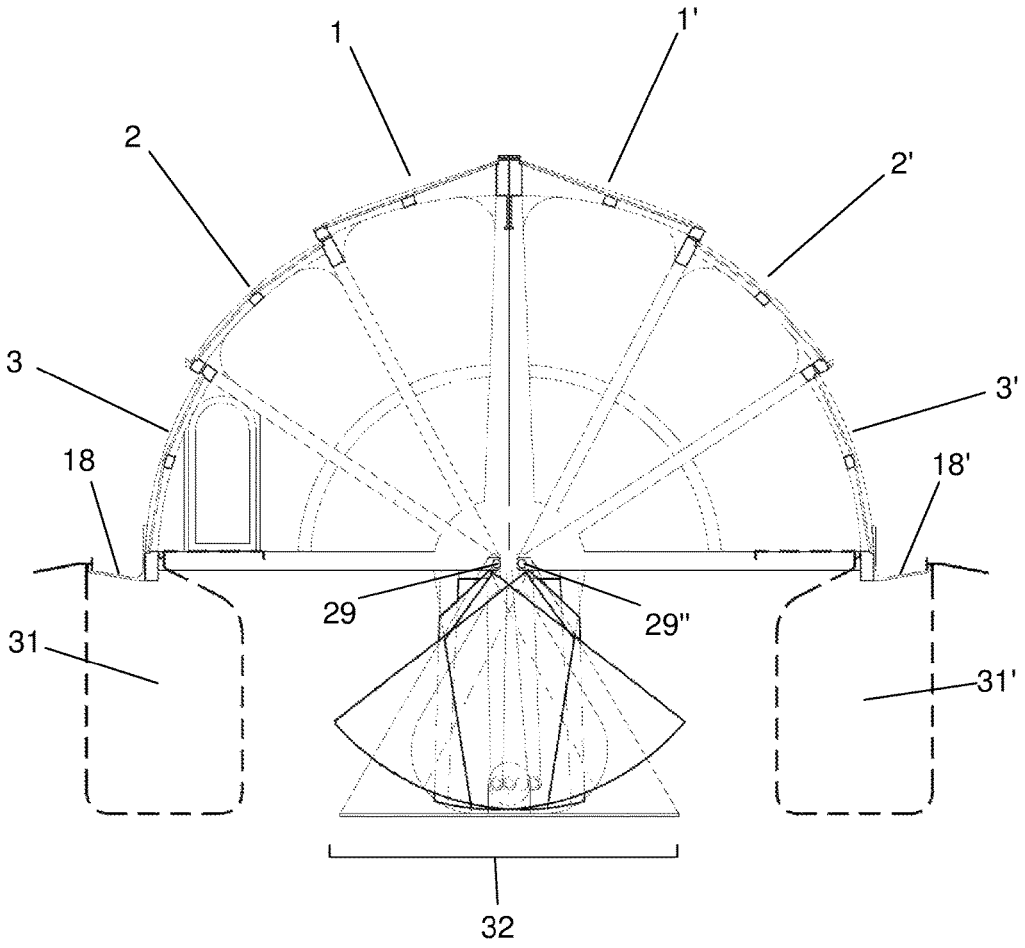
FIG. 6 is a cross sectional view of the enclosure in closed position and of the underground storage.

FIG. 6 is a transversal cross-sectional view of the deployed enclosure and underground housing, where it can be observed: Upper modules (1, 1'), middle modules (2, 2'), and lower modules (3, 3') with its storm sewers (18, 18'), the axes (29, 29"), underground housing compartments (31, 31'), and the group of counterweights (32) for each module.

Figure 7:
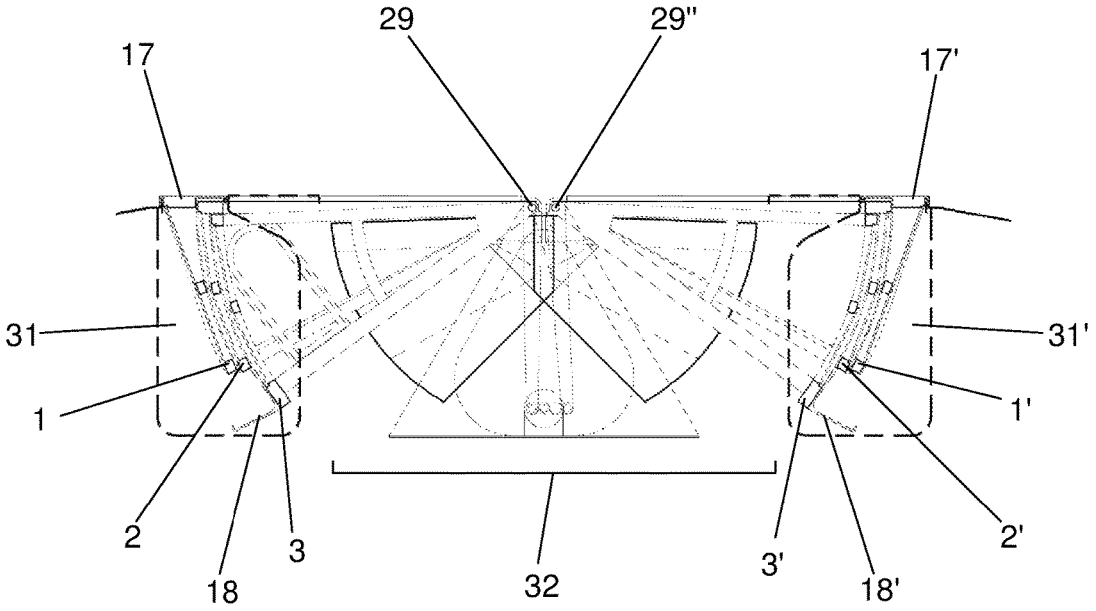
FIG. 7 is a view of a cross section of the enclosure retracted inside the lateral underground storage.

FIG. 7 is a cross sectional view of an open enclosure where all modules are retracted into the lateral underground housings, appreciating: upper modules (1, 1'), middle modules (2, 2'), lower modules (3, 3') with its attached storm gutters (18, 18'), covers (17, 17') for the upper modules (1, 1') of each half, the axes (29, 29"), side underground housing (31, 31'), and a group of counterweights (32) for each module.

Figure 8:
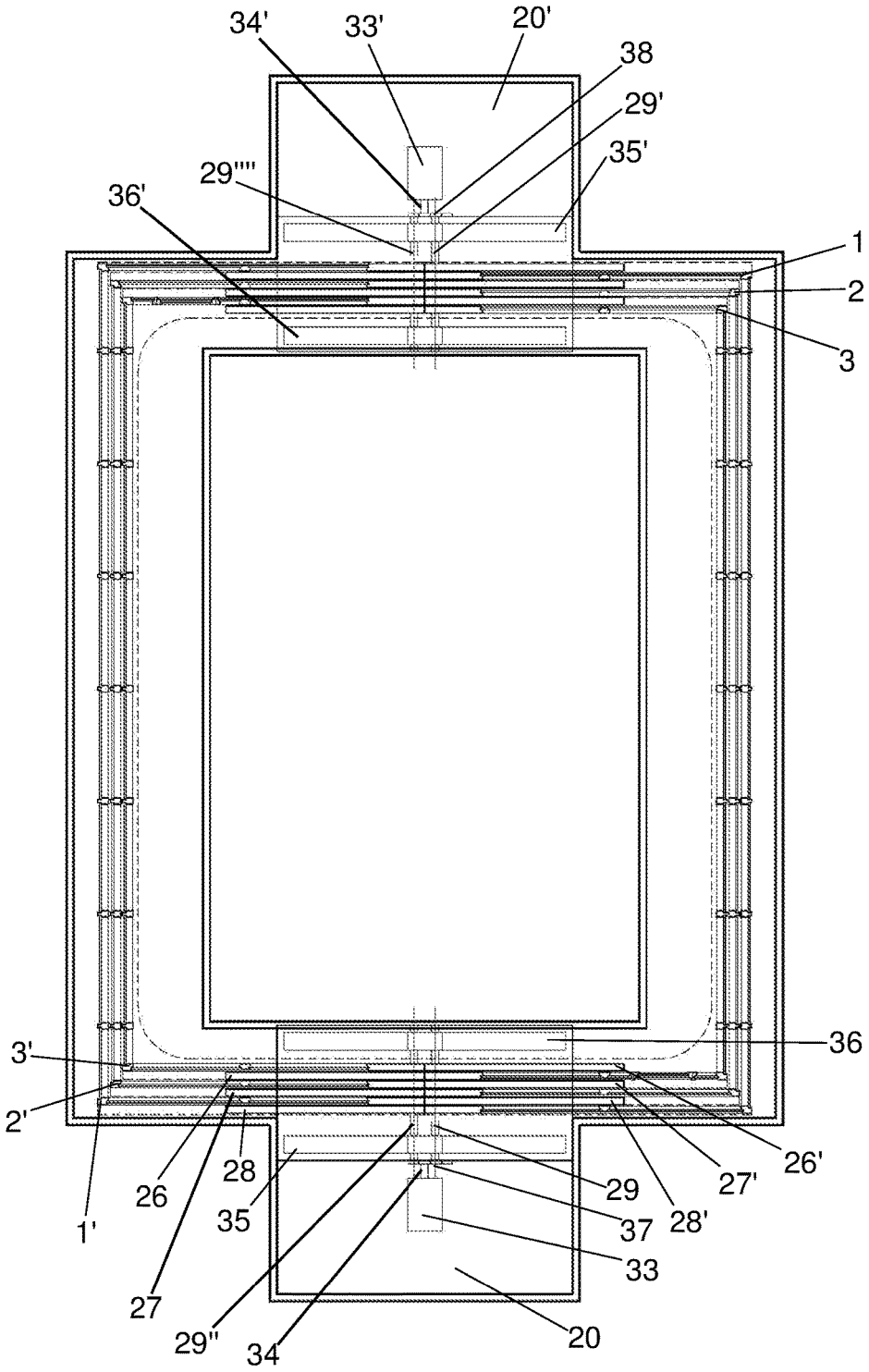
FIG. 8 is a top view of the retracted enclosure with the covers and the upper slabs of the underground storage removed.

FIG. 8 is a top view of the inventive enclosure in the open position with its covers removed to appreciate the disposition of the modules (1, 2, 3, 1', 2', 3') in the underground housing, engine compartments (20, 20'), motors (33, 33'), axis of each motor (34, 34'), affixing and supporting structures (35, 36, 35', 36') for the axes corresponding to each side of the enclosure (29, 29", 29''', 29''''), gearbox reductions for each motor (37, 38), and frontal extensions of each module with its counterweights (26, 27, 28, 26', 27', 28').

Figure 9:
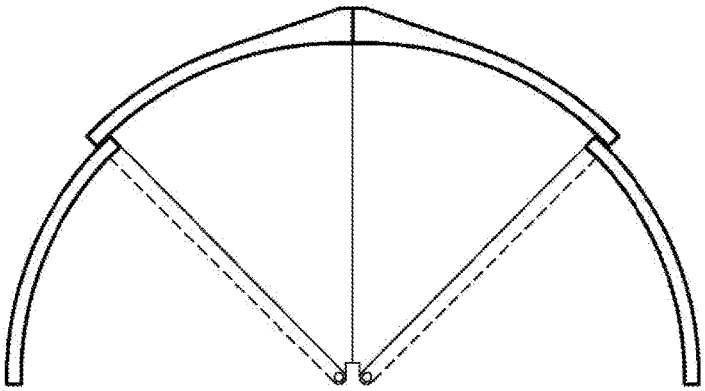
FIG. 9 is a schematic view of the modules in cross section of an alternative enclosure of four modules where the arrangement of the modules can be seen in closed position.

FIG. 9 is a schematic cross sectional view an alternative embodiment of the inventive enclosure comprising four modules in a deployed mode.

Figure 10:
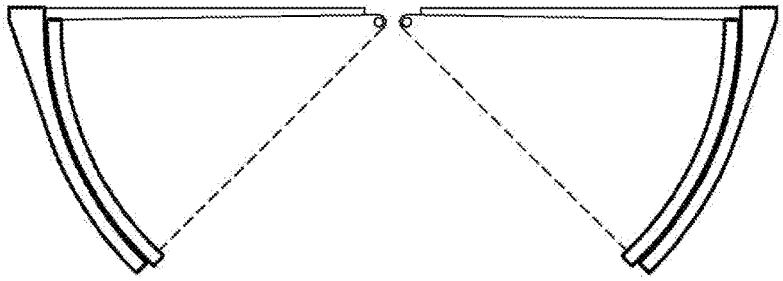
FIG. 10 is a schematic view of the modules in cross section of an alternative enclosure of four modules where the arrangement of modules can be seen in open position.

FIG. 10 is a schematic cross sectional view an alternative embodiment of the inventive enclosure comprising four modules in an open mode.

Figure 11:
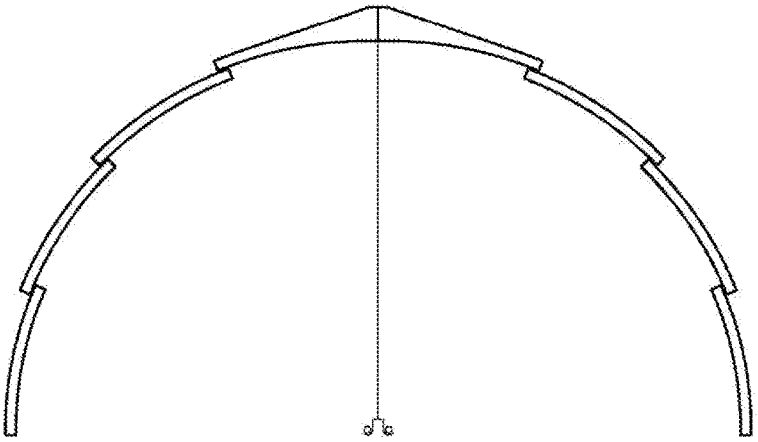
FIG. 11 is a schematic view of the modules in cross section of an alternative enclosure of eight modules where the arrangement of modules can be seen in closed position.

FIG. 11 is a schematic cross sectional view yet another alternative embodiment of the inventive enclosure comprising eight modules in a deployed mode.

Figure 12:
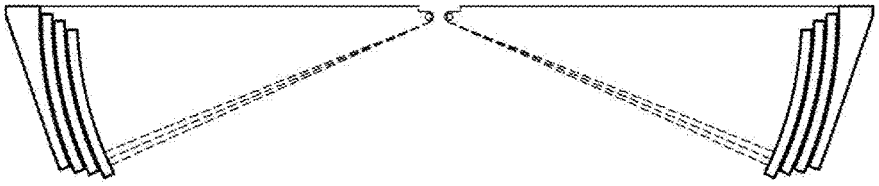
FIG. 12 is a schematic view of the modules in cross section of an alternative enclosure of eight modules where the arrangement of modules can be seen in open position.

FIG. 12 is a schematic cross sectional view yet another alternative embodiment of the inventive enclosure comprising eight modules in an open mode.

Figure 13:
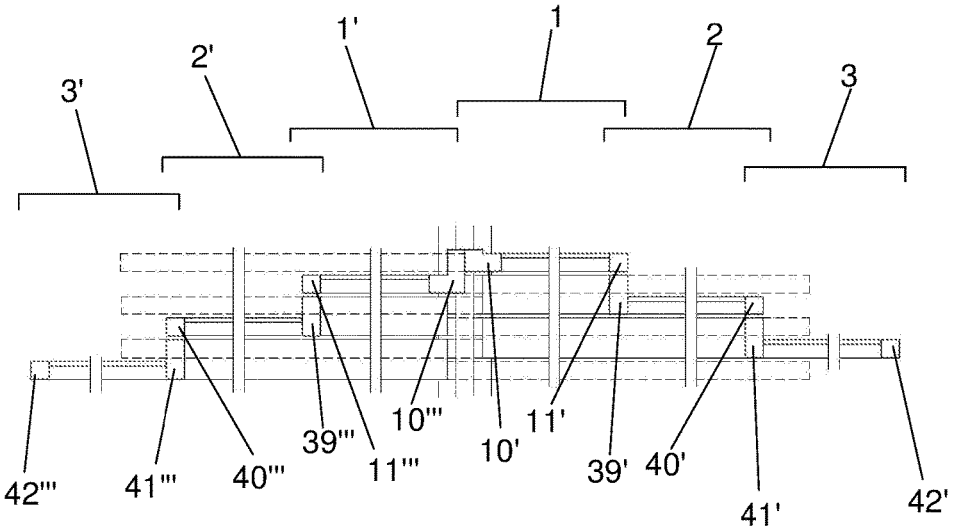
FIG. 13 is a top schematic view of an horizontal section of the back panels of the modules showing the location and of the axial profiles related modules being in open position.

FIG. 13 is a top schematic view of the horizontal section of the back panels of the modules showing, in the deployed position, the location and relationship amongst the axial panels of the modules. It can be appreciated the upper modules (1, 1'), each with its two axial profiles or lateral beams (10', 11', 10''', 11'''); middle modules (2, 2'), each with its two axial profiles or lateral beams (39', 40', 39''', 40'''), and lower modules (3, 3'), each with its two axial profiles or lateral beams (41', 42', 41''', 42''').

Figure 14:
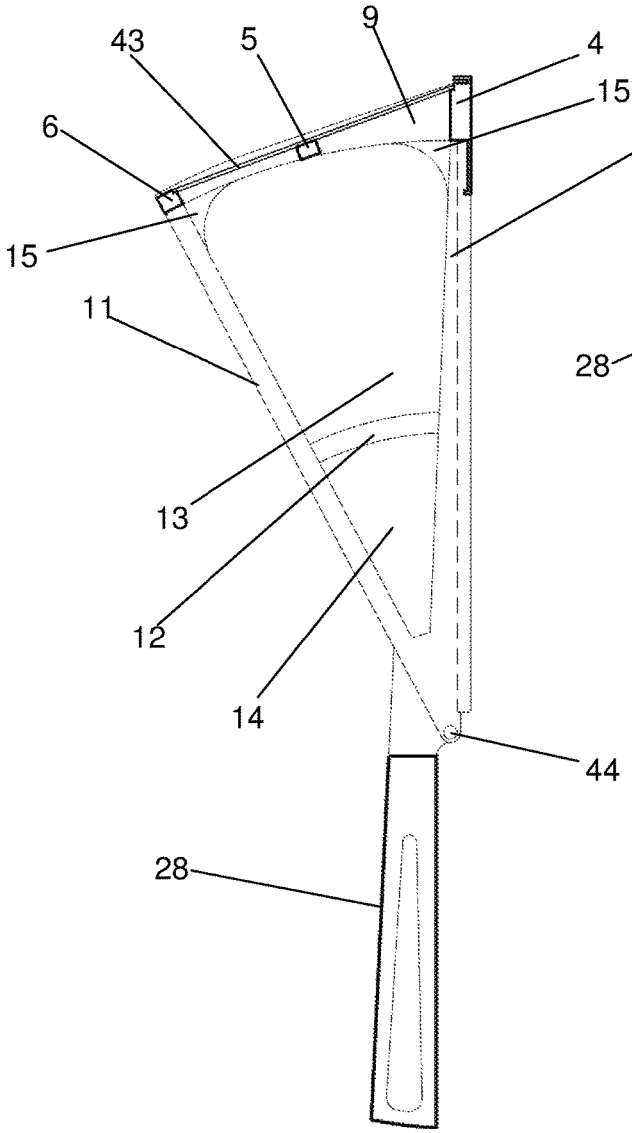
FIG. 14 is an internal cross-sectional view of the upper module.

FIG. 14 is an internal cross sectional view of the upper module where it can be observed the upper beam (4), middle beam (5), lower beam (6), foil material covering (43), and the wedge formed by an upper profile beam (9), two lateral or axial profiles beams (10, 11), a middle curved profile rib (12), foil material covering (13, 14), and supporting brackets (15, 15'). The axis passage (44) and the counterweight (28) are shown.

Figure 15:
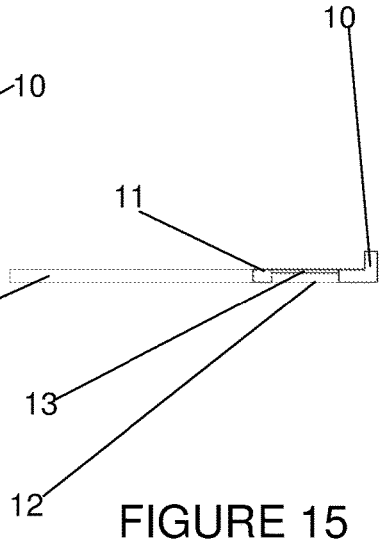
FIG. 15 is a cross sectional view of the front panel of the upper module.

FIG. 15 is a cross sectional view of the front panel of the upper module where it can be observed the internal face of one of the panels and the arrangement of the beams (10, 11), the curved profile (12), the foil material covering (13), and the counterweight (28).

Figure 16:
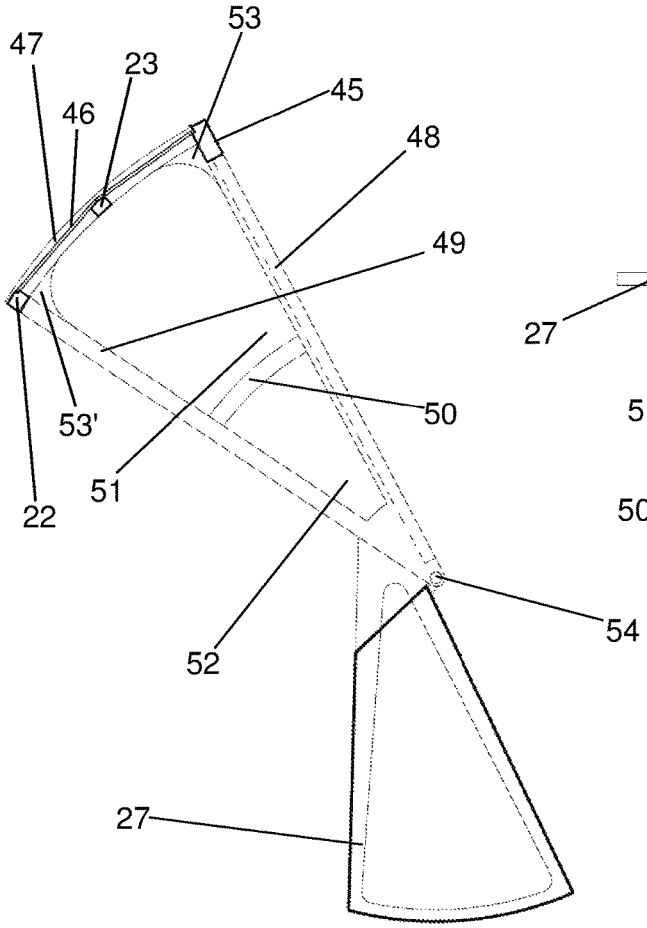
FIG. 16 is a cross sectional view of the middle module.

FIG. 16 is an internal cross sectional view of the middle module where it can be observed an upper beam (45), a middle beam (23), a lower beam (22), the foil material (46), and the wedge-type panel formed by a top rib or profile (47) and two lateral studs or profiles (48, 49), a curved profile (50), foil material covering (51, 52), and supporting brackets (53, 53'). The axis passage (54) and the counterweight (59) are shown.

Figure 17:
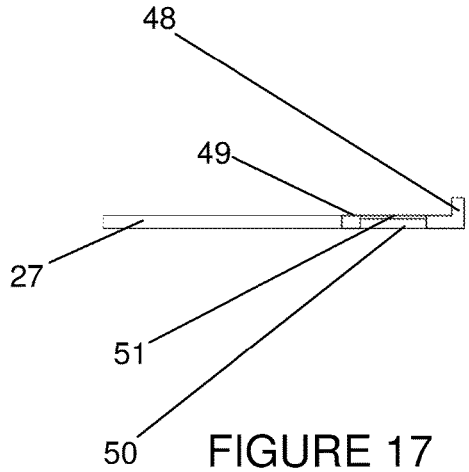
FIG. 17 is a cross sectional view of the front of the middle module.

FIG. 17 is a cross sectional view of the front panel of the middle module where it is shown the arrangement of the studs (48, 49), curved profile (50), foil material covering (51), and counterweight (27).

Figure 18:
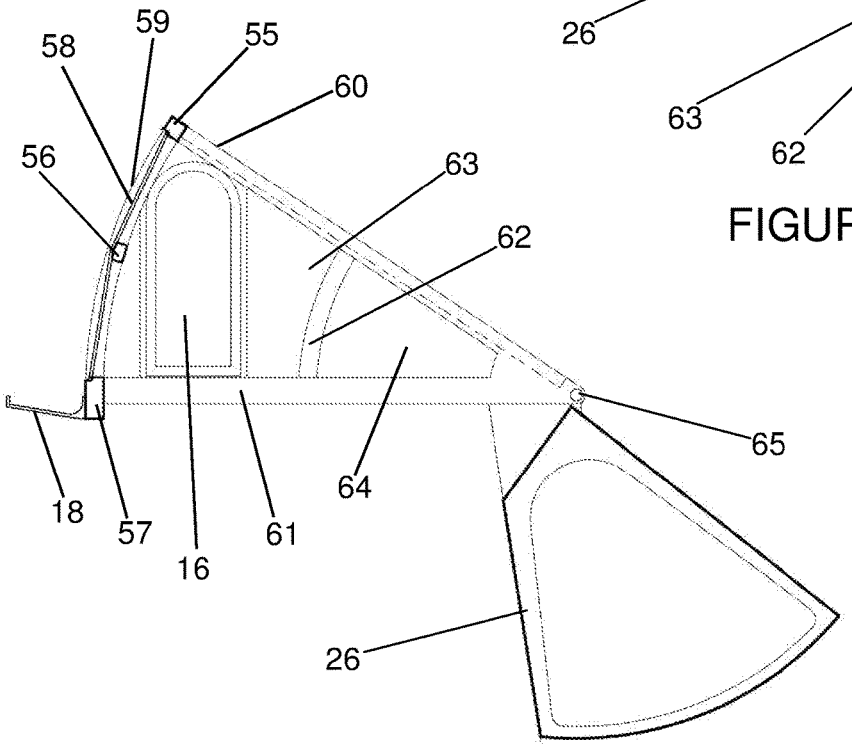
FIG. 18 is an internal cross sectional view of the lower module.

FIG. 18 is an internal cross sectional view of the lower module where it can be observed an upper beam (55), a middle beam (56), a lower beam (57), the foil material covering (58), and the wedge-type panel formed by a top rib or profile (59), two lateral studs or profiles (60, 61), a curved profile (62), foil material covering (63, 64). The axis passage (65), the counterweight (26), an opening represented by a door (16), and a gutter (18) are shown.

Figure 19:
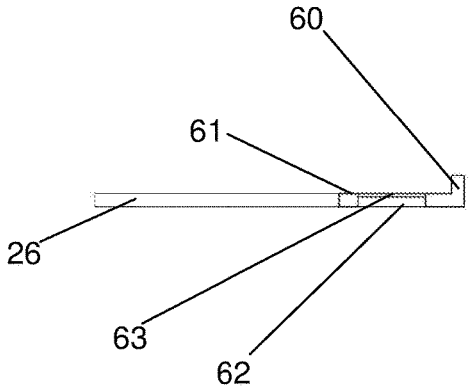
FIG. 19 is a cross sectional view of the lower front panel module.

FIG. 19 is a cross sectional view of the lower module where it is shown the internal face of one panel and the arrangement of studs (60, 61), the curved middle section (62), the foil material covering (63), and the counterweight (26).

Figure 20:
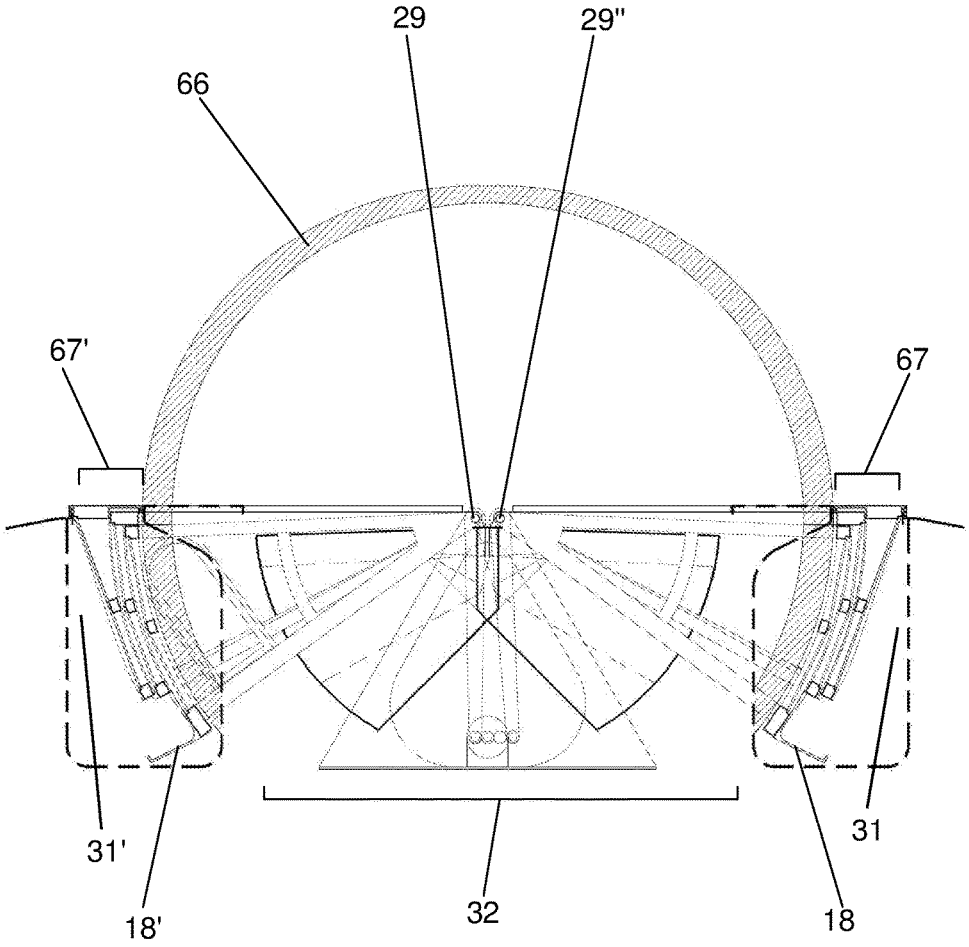
FIG. 20 is a view of a cross section of the enclosure in an open position and the lateral underground storage.

FIG. 20 is a cross sectional view of the deployed enclosure showing the lateral underground housings (31, 31'), the axes (29, 29"), the group of counterweights (32), an internal reinforcement arch (66), and the sets of modules (67, 67') in their respective underground housing (31, 31'), and gutters (18, 18').

Figure 21:
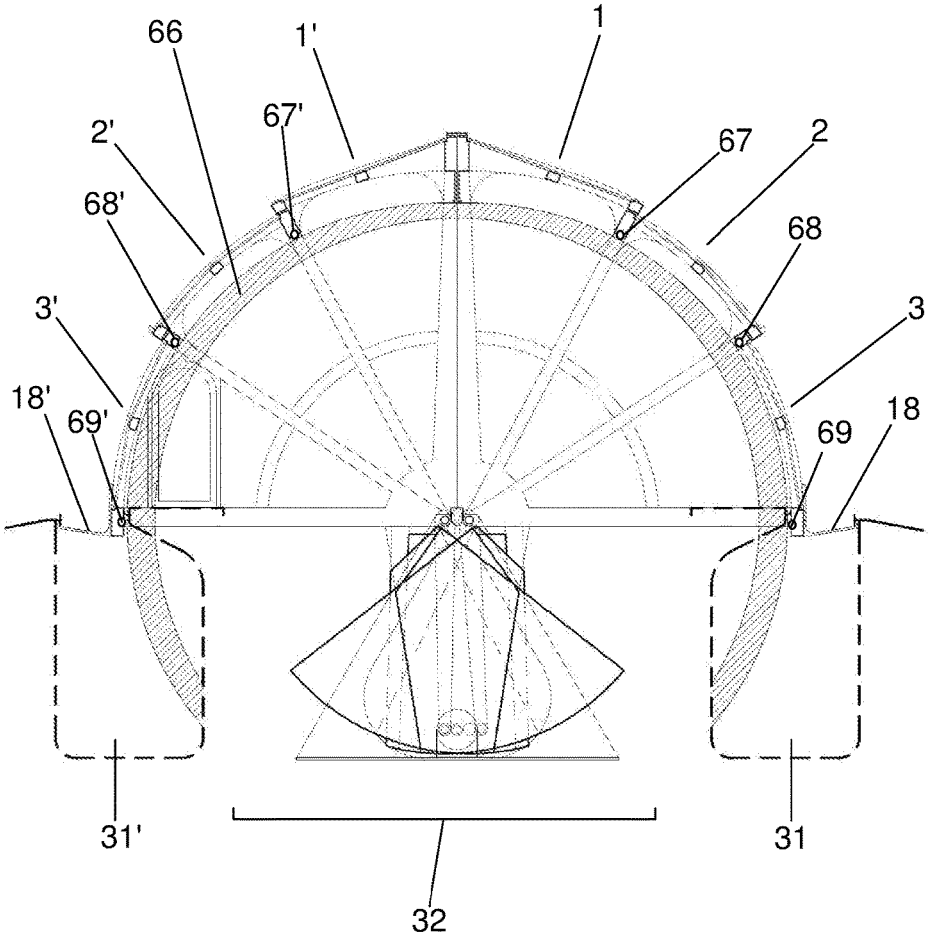
FIG. 21 is an internal view of a cross section of the enclosure in closed condition with side underground chambers.

FIG. 21 is an internal view of a cross section of the enclosure in the deployed position showing side underground housings (31, 31'), a group of counterweights (32), one of the internal reinforcement arches (66) shown to appreciate the relative position with reference to the upper (1, 1'), middle (2, 2') and lower (3, 3') modules for each half of the enclosure with their gutters (18, 18'), and bearings (67, 68, 69, 67', 68', 69') located on the inside of the beams corresponding to each half modules and rolling on the upper face of the arch (66).

Figure 22:
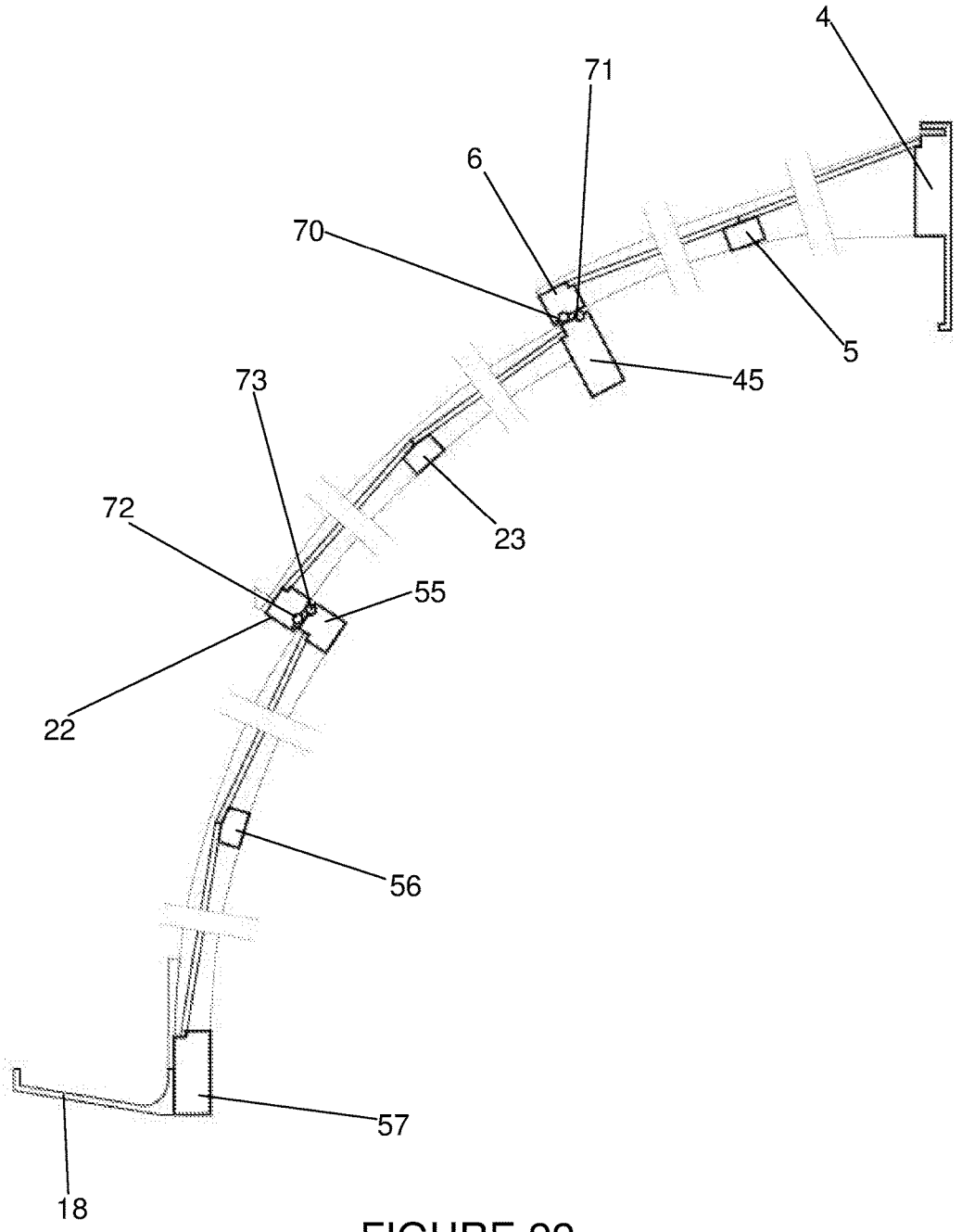
FIG. 22 is a schematic view of a cross section of half of the enclosure in closed position.

FIG. 22 is a schematic rear view of a cross section of one half of the deployed enclosure showing the upper beam (4), middle beam (5), and lower beam (6) of the upper module, the last one (6) having bearings (70) on its lower side; the middle module with an upper beam (45) presenting a bearing (71) on its upper side, a middle beam (23), and lower beam (22) presenting a bearing (72) on its lower side; lower module, presenting gutters (18), an upper beam (55) presenting a bearing (73) on its upper face, a middle beam (56), and lower beam (57); said bearings permit the modules to roll over the matching faces of the ribs or profiles that are perpendicular to the beams.

Figure 23:
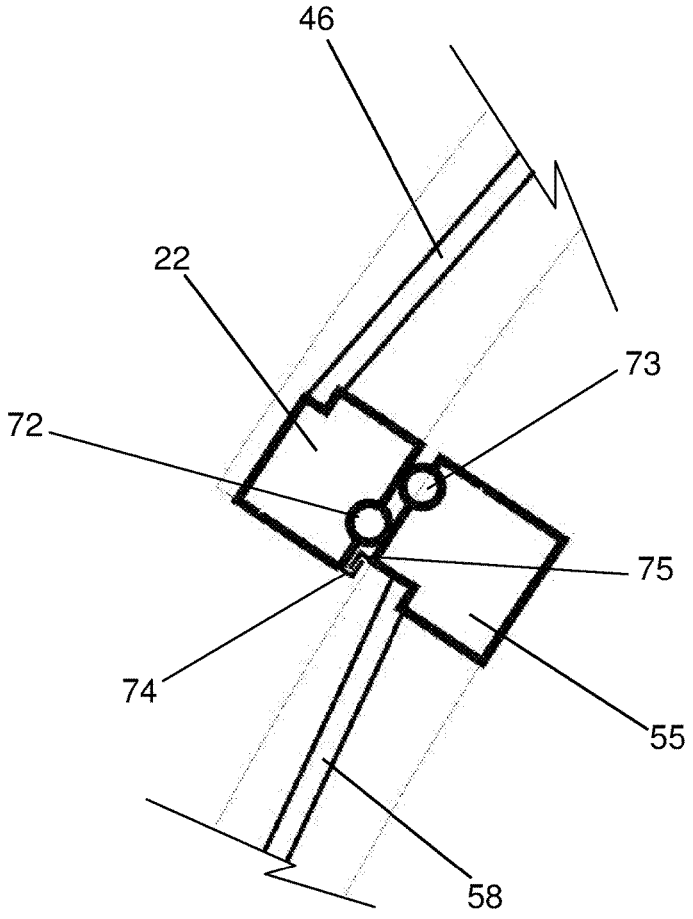
FIG. 23 is a schematic view of an approach of a cross section of half of the enclosure that shows how the beams of the modules are related in closed position.

FIG. 23 is a detailed schematic view of a cross section of a joint of two modules showing how the beams of the modules, in this example the middle module's lower beam (22) with its flange, hook, or stop (74) and bearing (72), allow the pulling of the lower modules, with or without the help of bearings, from the lower module with his upper beam (55) with its flange, hook, or cap (75) and bearing (73), and the respective foil material covering (46, 58).

Figure 24:
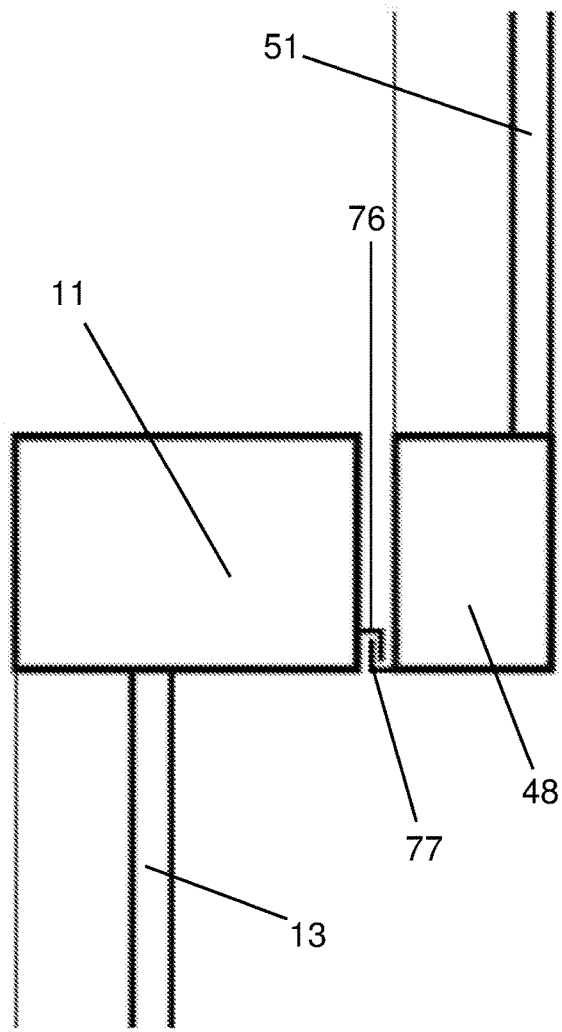
FIG. 24 is a schematic view of an approach of a cross section of the axial profiles of the envelope in closed position showing how the axial sections of the panels of the modules are related.

FIG. 24 is a schematic view of a cross section of the axial profiles of the deployed enclosure showing how the axial sections of the panels of the modules are related when deployed. In this case, the upper module with its lower beam (11) and its flange, hook, or cap (76) meet middle module's upper beam (48) and its flange, hook, or cap (77) and the respective foil material coverings (13, 51).

Figure 25:
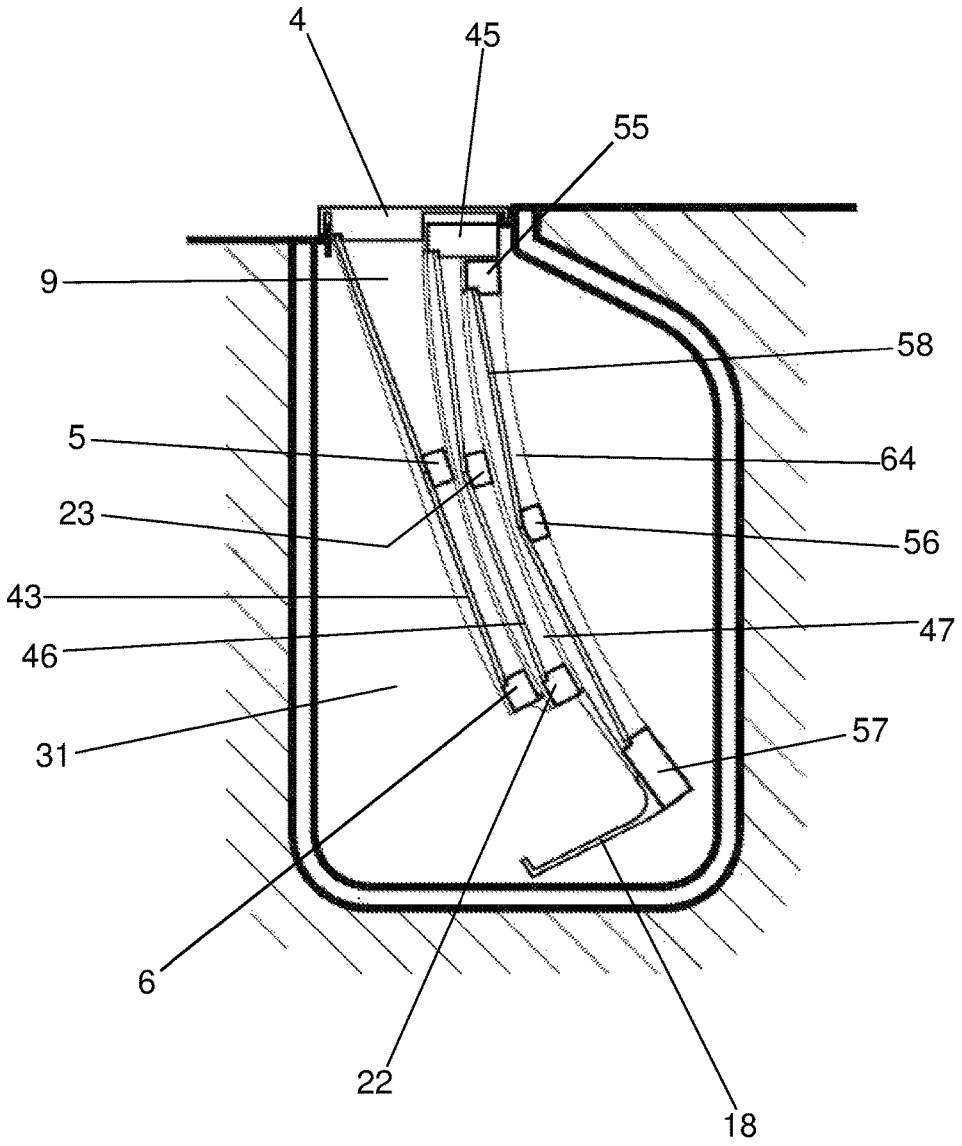
FIG. 25 is a view of a cross section of one underground storage and the structure in open position.

FIG. 25 is a view of a cross section of one underground housing (31) showing the upper module with an upper beam (4), a middle beam (5), a lower beam (6), the foil material covering (43), and an upper profile beam (9); the middle module with an upper beam (45), a middle beam (23), a lower beam (22), the foil material covering (46), and an upper profile beam (47); the lower module with an upper beam (55), a middle beam (56), a lower beam (57), the foil material covering (58), upper profile beam (59), and gutters (18).

Figure 26:
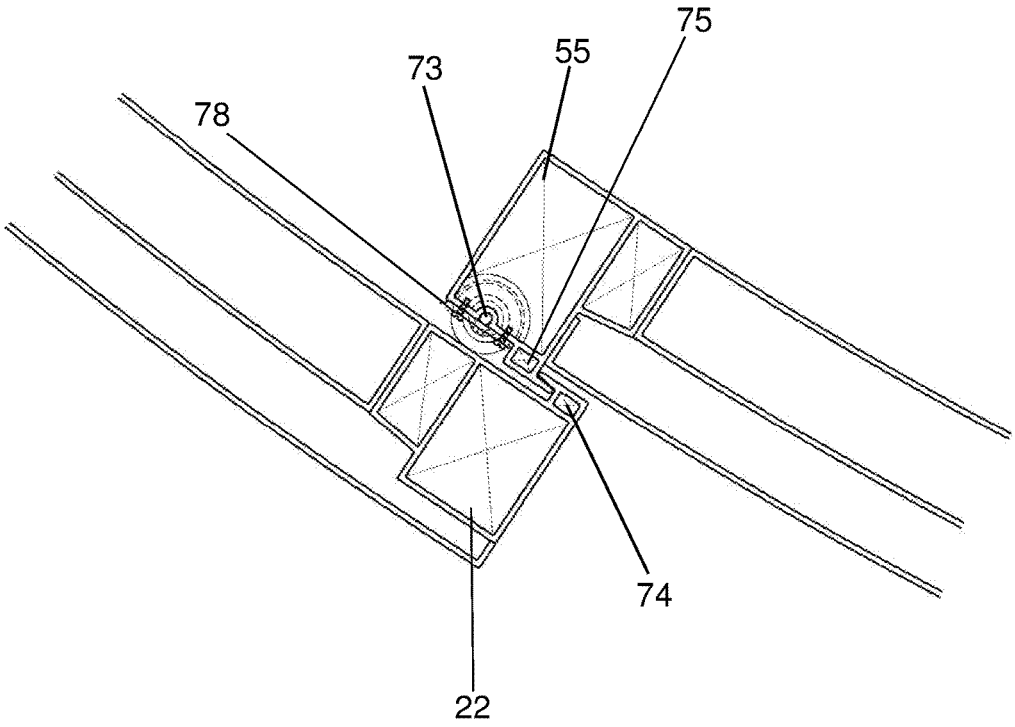
FIG. 26 is a side view of an approach one to a bearing.

FIG. 26 is a side view, in this case of the middle module's lower beam (22) with its flange, hook, or stop (74), in contact with lower module's upper beam (55) with its flange, hook, or cap (75), bearing (73), and the retaining bearing plate (78).

Figure 27:
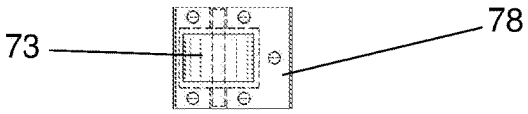
FIG. 27 is a lower view of one of the bearings.

FIG. 27 is a bottom view of one of the bearings in which the bearing (73) and the retaining plate of the bearing (78) are shown.

Figure 28:
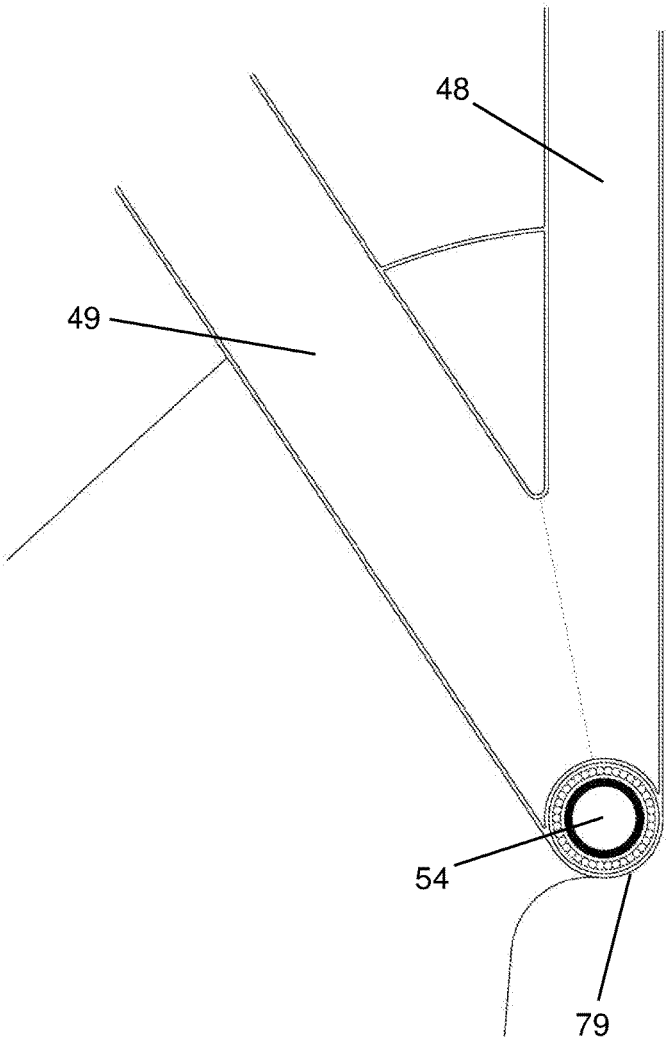
FIG. 28 is a front view of the bearing hole through which passes one of the axes.

FIG. 28 is a front view showing a bearing (79) in the axis passage (54) in the middle module, also shown two lateral studs or profiles (48, 49).

Figure 29:
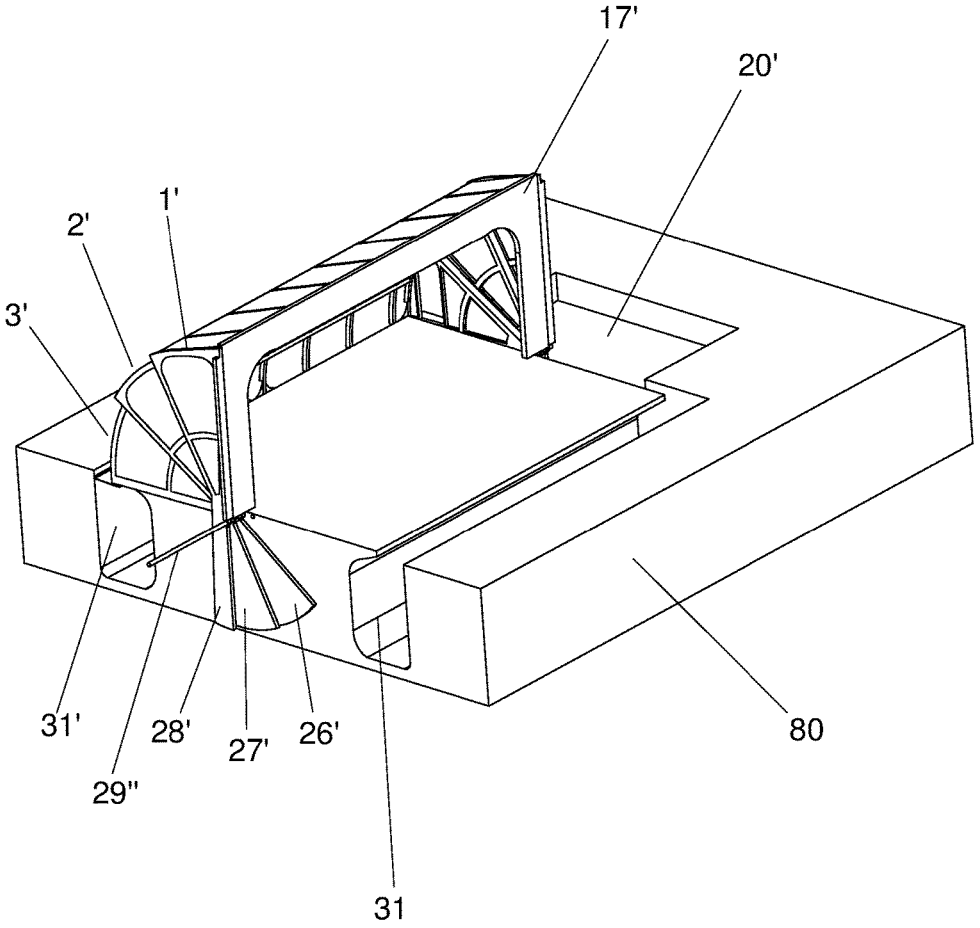
FIG. 29 is a perspective view showing the arrangement of the closed halves of the enclosure and a traverse cut for a better appreciation of the underground storage.

FIG. 29 is a perspective view showing half of the enclosure deployed showing a transversal cut to the soil for better appreciation of the underground housings. It can be appreciated the upper module (1') with its counterweight (28'), the middle module (2') with its counterweight (27'), and the lower module (3') with its counterweight (26'), the closure or attack beam (17') corresponding to this half of the enclosure formed by the attack profiles, the engine compartment (20') where a motor may be housed, the lateral underground housing (31, 31'), the axis (29"), shown extended for a better visualization.

It is logical to assume that this invention may be implemented with modifications insofar as construction materials and number of modules, but without departing from the basic principles that are clearly specified in claims bellow.

What I claimed is:

1. A multifunctional enclosure for covering any surface, be it indoors or outdoors, the enclosure opening and closing telescopically, the enclosure comprising:

at least two groups of independent modules, each module comprising:

a cross-linked structure comprising: a plurality of curved cross sections, a plurality of longitudinal beams, interconnected and intertwined with the curved cross sections through knots delimiting multiple panels, a plurality of laminar material disposed upon a demarcated space delimited by the multiple panels, a front side face, a rear side face, both front and rear side faces comprising panels with multiple curved profiles and multiple cross radial beams, the independent modules, being morphologically similar to wedges, are communicatively connected to a common axis and are communicatively connected and movable by means of hooks and rollers, such that on deployment they commonly define a mobile telescopic ceiling;

each group of independent modules converging on at least one rotating axis upon which the enclosure is deployed or retracted by drive means, setting such an enclosure to a parabolic arch condition when operatively deployed;

a peripheral moat dimensioned to surround the surface to be covered, the moat comprising a chamber sized to house underground all the independent modules and the drive means;

and a peripheral moat lid having closure means.

2. A multifunctional enclosure according to claim 1, wherein the enclosure is divided into two opposing and parallel semi-circular halves, as a means of closing a parabolic arch made of the independent modules.

3. A multifunctional enclosure according to claim 1, wherein to deploy the enclosure one independent module tows the other modules.

4. A multifunctional enclosure according to claim 1, wherein the at least one rotary axis is located below ground level and are parallel to each other.

5. A multifunctional enclosure according to claim 1, wherein the closure means is a lid with a rainwater collector.

6. A multifunctional enclosure according to claim 1, wherein the independent modules have openings.

7. A multifunctional enclosure according to claim 6, wherein the openings are selected from a group consisting of doors and windows.

8. A multifunctional enclosure according to claim 1, wherein the rollers comprise rolling bearings.

9. A multifunction enclosure according to claim 1, wherein each independent module has an extension beyond the axis consisting of a counterweight to reduce the energy required for module rotational displacement.

10. A multifunction enclosure according to claim 1, wherein the drive means include at least one selected from a group consisting of manual operation, mechanical levers operation, motorized operation, and programmable motorized operation.

* * * * *